US007610711B2

(12) United States Patent
Oz

(10) Patent No.: US 7,610,711 B2
(45) Date of Patent: Nov. 3, 2009

(54) TELESCOPING LEG

(75) Inventor: Moshe Oz, Tel-Aviv (IL)

(73) Assignee: TDI Arms, Ltd., Yauneh (IL)

( * ) Notice: Subject to any disclaimer, the term of this patent is extended or adjusted under 35 U.S.C. 154(b) by 362 days.

(21) Appl. No.: 11/487,617

(22) Filed: Jul. 17, 2006

(65) Prior Publication Data

US 2007/0011932 A1 Jan. 18, 2007

Related U.S. Application Data

(60) Provisional application No. 60/700,259, filed on Jul. 18, 2005.

(51) Int. Cl.
*F41C 27/00* (2006.01)

(52) U.S. Cl. ..... 42/94

(58) Field of Classification Search ..... 42/94
See application file for complete search history.

(56) References Cited

U.S. PATENT DOCUMENTS 1,332,992 A * 3/1920 Moore et al. ..... 124/6
2,436,349 A * 2/1948 Adams ..... 42/94
2,489,283 A 11/1949 Garand
2,518,452 A * 8/1950 Davis, Jr. et al. ..... 89/37.05
2,807,904 A * 10/1957 Kreske ..... 42/94
2,844,905 A 7/1958 Walton at at
4,345,398 A 8/1982 Pickett
4,525,052 A * 6/1985 Kosugi et al. ..... 396/419
4,625,620 A * 12/1986 Harris ..... 89/37.04
5,345,706 A * 9/1994 Brown ..... 42/94
6,305,116 B1 10/2001 Parker

FOREIGN PATENT DOCUMENTS

| | | |
|---|---|---|
| DE | 2349609 | 4/1975 |
| GB | 2345202 | 8/2000 |
| WO | WO 03/102488 | 12/2003 |

* cited by examiner

*Primary Examiner*—Bret Hayes
(74) *Attorney, Agent, or Firm*—Robert L. Stone

(57) ABSTRACT

A telescoping leg for a firearm, the telescoping leg including a housing, a first telescoping portion mounted inside the housing, means for extending the first telescoping portion a second telescoping portion mounted inside the first telescoping portion, and means for extending the second telescoping portion.

16 Claims, 9 Drawing Sheets

TELESCOPING LEG

This application claims the benefit of Provisional Application No. 60/700,259, filed Jul. 18, 2005.

FIELD OF THE INVENTION

The present invention relates to telescoping legs for firearms, in general and, in particular, to telescoping legs for rifles, carbines and similar firearms.

BACKGROUND OF THE INVENTION

A telescoping rear third leg for sniper and sharpshooter rifles is well known. This permits the shooter to rest the firearm on a solid support, such as the ground or a wall, and to adjust the height of the firearm. However, conventional rear telescoping legs are limited in operation, as they have one means of adjustment, consisting of a single extension of the leg.

SUMMARY OF THE INVENTION

There is provided according to the present invention a telescoping leg for a firearm including a housing, a first telescoping portion mounted inside the housing, and a second telescoping portion mounted inside the first telescoping portion.

According to one embodiment, the first telescoping portion is spring loaded inside the housing and the second telescoping portion is spring loaded inside the first telescoping portion.

According to a preferred embodiment of the invention, the telescoping leg further includes a screw thread portion for rotation of said first portion relative to said second portion, for fine adjustment of the length of the leg.

Further according to a preferred embodiment, the telescoping leg includes a pivot mechanism permitting the leg to be pivoted and locked in a folded position adjacent to a stock of the firearm, in a fully open position substantially perpendicular to the folded position, and in at least one intermediate position between the folded position and the fully open position.

There is also provided in accordance with the invention, a method for forming a telescoping leg for a firearm, the method including mounting a first telescoping portion inside a housing, and mounting a second telescoping portion inside the first telescoping portion.

BRIEF DESCRIPTION OF THE DRAWINGS

The present invention will be further understood and appreciated from the following detailed description taken in conjunction with the drawings in which.

DETAILED DESCRIPTION OF THE INVENTION

The present invention relates to a telescoping leg for a firearm which can be extended to almost three times its length when collapsed, and which can be rapidly and easily raised and lowered to permit rapid adjustment and re-adjustment of the angle of fire of the firearm. According to one embodiment of the invention, the telescoping leg is mounted on a removable stock for a firearm having a long buffer (the tube connecting the bore of the firearm to the stock), and is particularly suitable for use with M16-type or SR-25-type sniper and sharpshooter rifles. According to an alternative embodiment of the invention, the telescoping leg is mounted on a removable stock for a firearm having a short buffer, and is particularly suitable for use with M16 carbines or rifles having shorter buffers. In addition, the telescoping leg can be mounted on AK47 rifles or other similar firearms by using a mounting adapter to mount the removable stock on the firearm. In addition, the telescoping leg can be mounted on the stocks of hunting rifles and similar firearms, or on any firearm including, but not limited to, guns, pistols, grenade & mortar launchers, by means of an appropriate adaptor for the telescoping leg.

Figure 1:
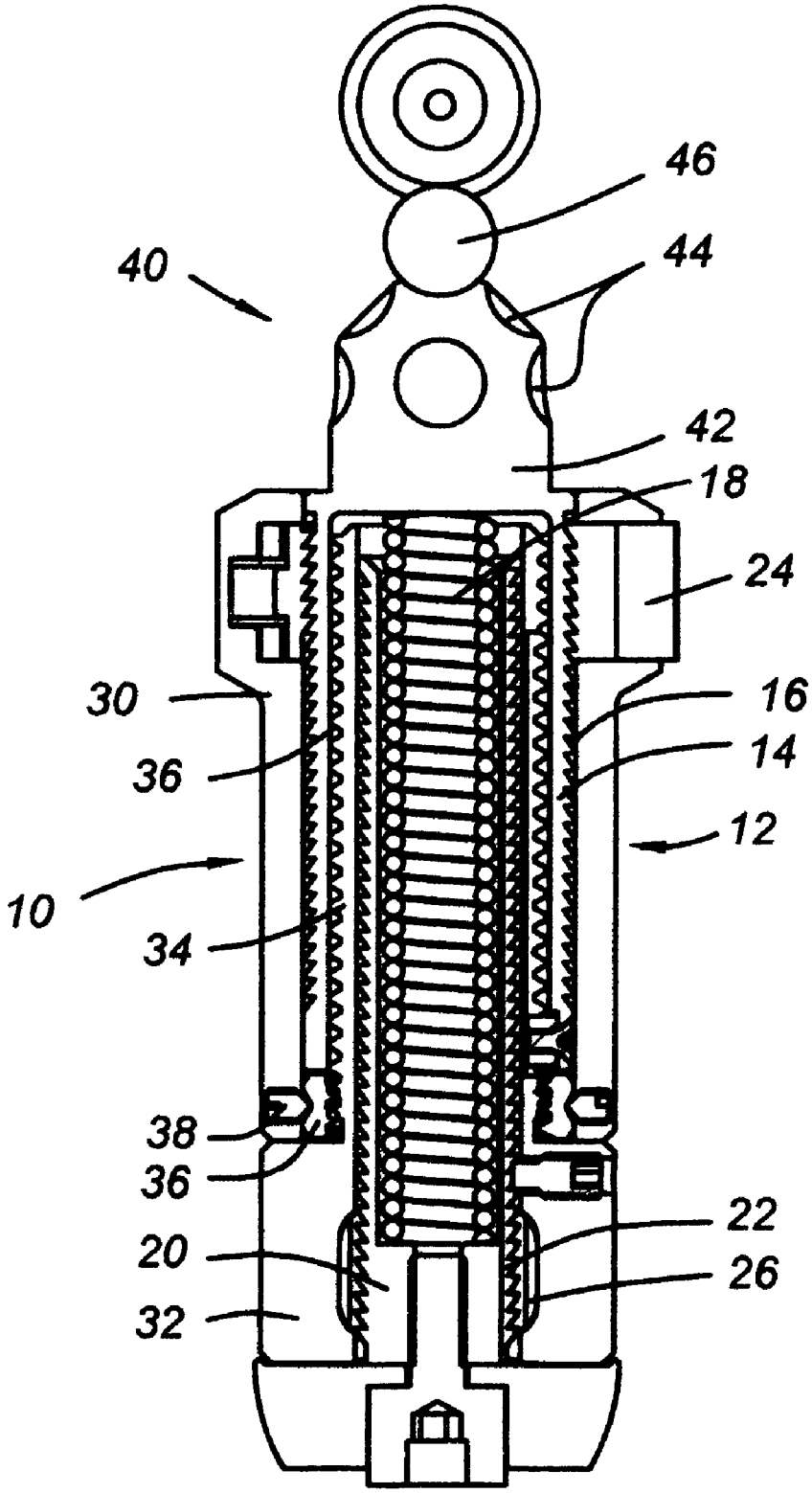
FIG. 1 is a sectional illustration of a telescoping leg constructed and operative in accordance with one embodiment of the present invention in a collapsed orientation.

Referring now to FIG. 1, there is shown a sectional illustration of a telescoping leg 10 constructed and operative in accordance with one embodiment of the present invention in a collapsed orientation. Leg 10 includes a housing 12 with a first portion 14 telescopingly mounted inside housing 12, and a second portion 20 telescopingly mounted inside first portion 14. First portion 14 has external threading 16, most preferably buttress thread and may be biased against a compression spring 18. Second portion 20 also has external threading 22, most preferably buttress thread facing the opposite direction to threading 16, and may be biased against a compression spring 21 .seen in FIG. 5 According to one embodiment of the invention, first portion 14 and the second portion 20 are spring biased against separate springs, one for each portion. According to an alternative embodiment of the invention, a single spring serves to bias and extend both the first and the second portion. Alternatively, any other method of providing telescoping movement, such as an hydraulic mechanism, may be utilized.

An upper release button 24 is mounted in housing 12 for releasing first telescoping portion 14 to help lift a firearm to which the leg 10 is attached. A lower release button 26 is mounted in housing 12 for releasing second telescoping portion 20 downwards from the firearm.

According to a preferred embodiment of the invention, the housing is formed of two parts, an upper housing 30 with upper release button 24 mounted therein, and a lower housing 32 with lower release button 26 mounted therein. Lower housing 32 includes an upstanding cylindrical portion 34 having external screw threads 36. Screw threads 36 are preferably simple spiral threads. Cylindrical portion 34 is mounted in first portion 14, and second portion 20 is mounted in cylindrical portion 34. A nut 36*a* is mounted about cylindrical portion 34 and upper housing 20 is locked to nut 36*a* as by a set screw 38. In this fashion, upper housing 30 and upper portion 14 can rotate together about cylindrical portion 34 relative to second portion 20, to permit fine tuning of the height of the telescoping leg 10.

Telescoping leg 10 may also include a rubber base (not shown) for added stability and to permit additional fine tuning of the height of the stock by pressing down on the firearm.

Figure 7A:
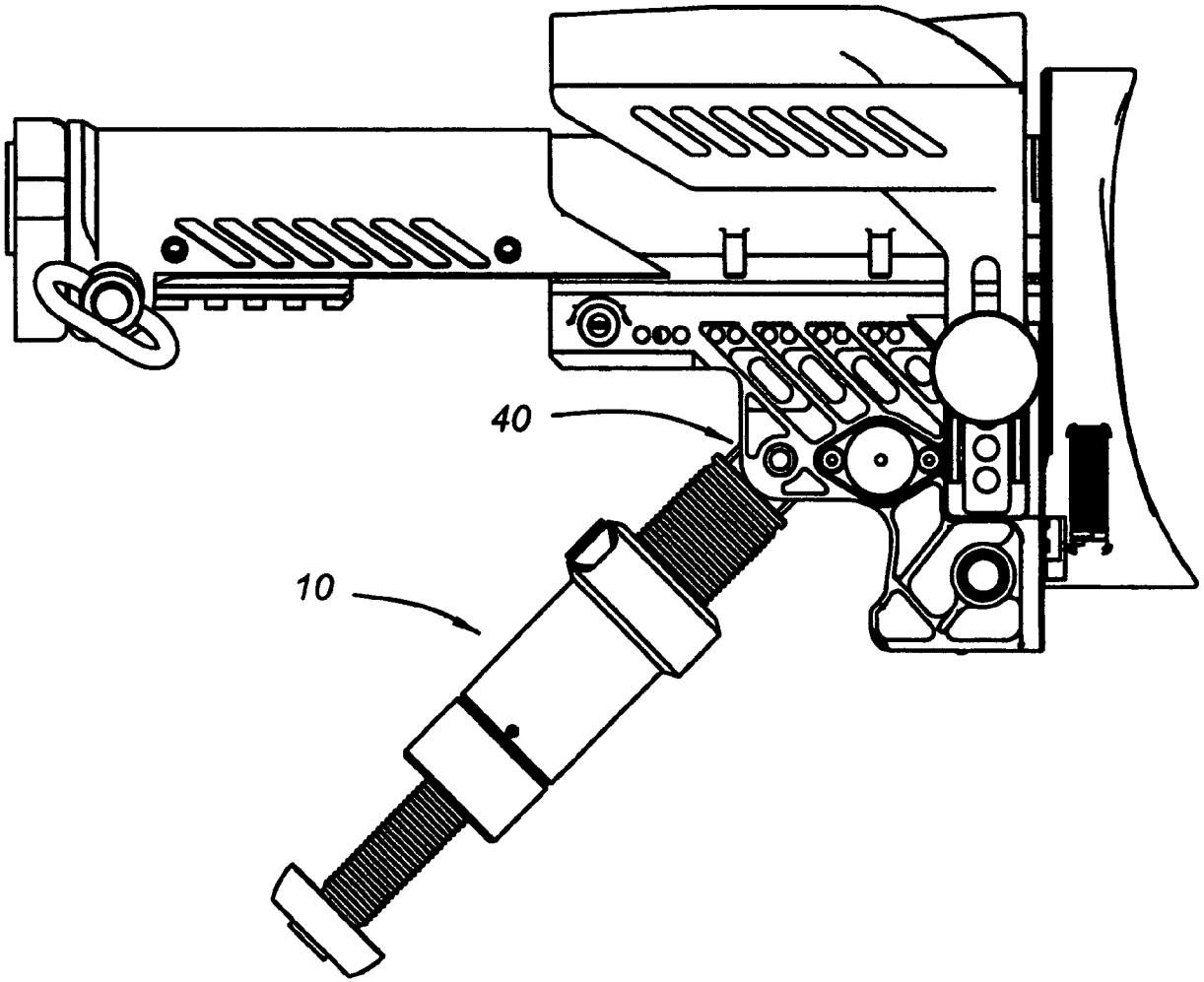
FIGS. 7*a* and 7*b* are illustrations of stocks, according to FIG. 2*a* and FIG. 5 respectively, having telescoping legs in intermediate positions.
Figure 7B:
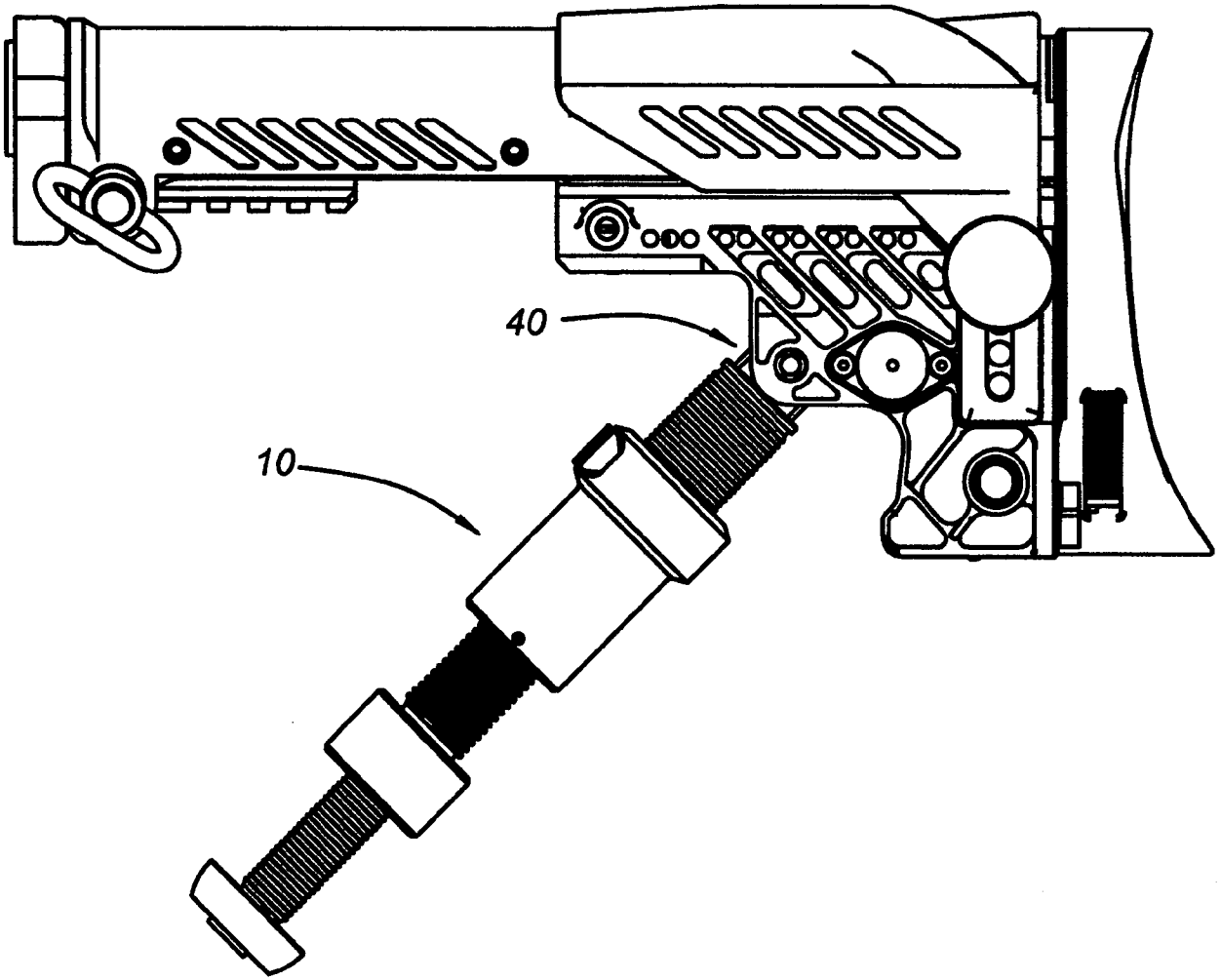

Telescoping leg 10 includes a coupling element 40 for coupling to the stock of a firearm. Preferably, coupling element 40 includes a pivot mechanism permitting the leg 10 to be pivoted and locked in each of several different positions: a folded position adjacent a stock of the firearm, a fully open position substantially perpendicular to the folded position, and at least one, and preferably several, intermediate positions between the folded position and the fully open position. This permits the user to lock the leg at an angle smaller than 90° in a stable position for shooting, as shown, for example in FIGS. 7*a* and 7*b*. It is a particular feature of the invention that the stock is stable in all these positions.

According to the illustrated embodiment, the pivot mechanism includes a head 42 having a plurality of dimples 44. A complementary ball 46 is mounted in the stock (not shown). Pivoting of leg 10 causes ball 46 to move between dimples 44 and to lock in the selected position. Thus, the number and location of the dimples 46 about the head 42 determine the positions in which the leg can be locked relative to the stock. Coupling element 40 may include a pivot release button 47 (seen in FIG. 2*b*) on either side of the stock, to permit releasable locking in the desired position. Preferably, coupling element 40 is symmetrical to permit mounting for left-handed shooters or right-handed shooters.

FIGS. 2*a*, 2*b*, 3 and 4 are respective schematic folded side and side sectional, and extended side and side sectional illustrations of a stock 50 having a long buffer tube 52 for a firearm (not shown) having a long buffer. Stock 50 includes an extendable cheek rest 54, and an extendable butt plate 56. Pivotally mounted on stock 50 is a telescoping leg 10, according to FIG. 1. Like elements from FIG. 1 have like reference numerals. Telescoping leg 10, in its collapsed and folded orientation seen in FIG. 2*a*, can also serve as a handle.

Figure 2A:
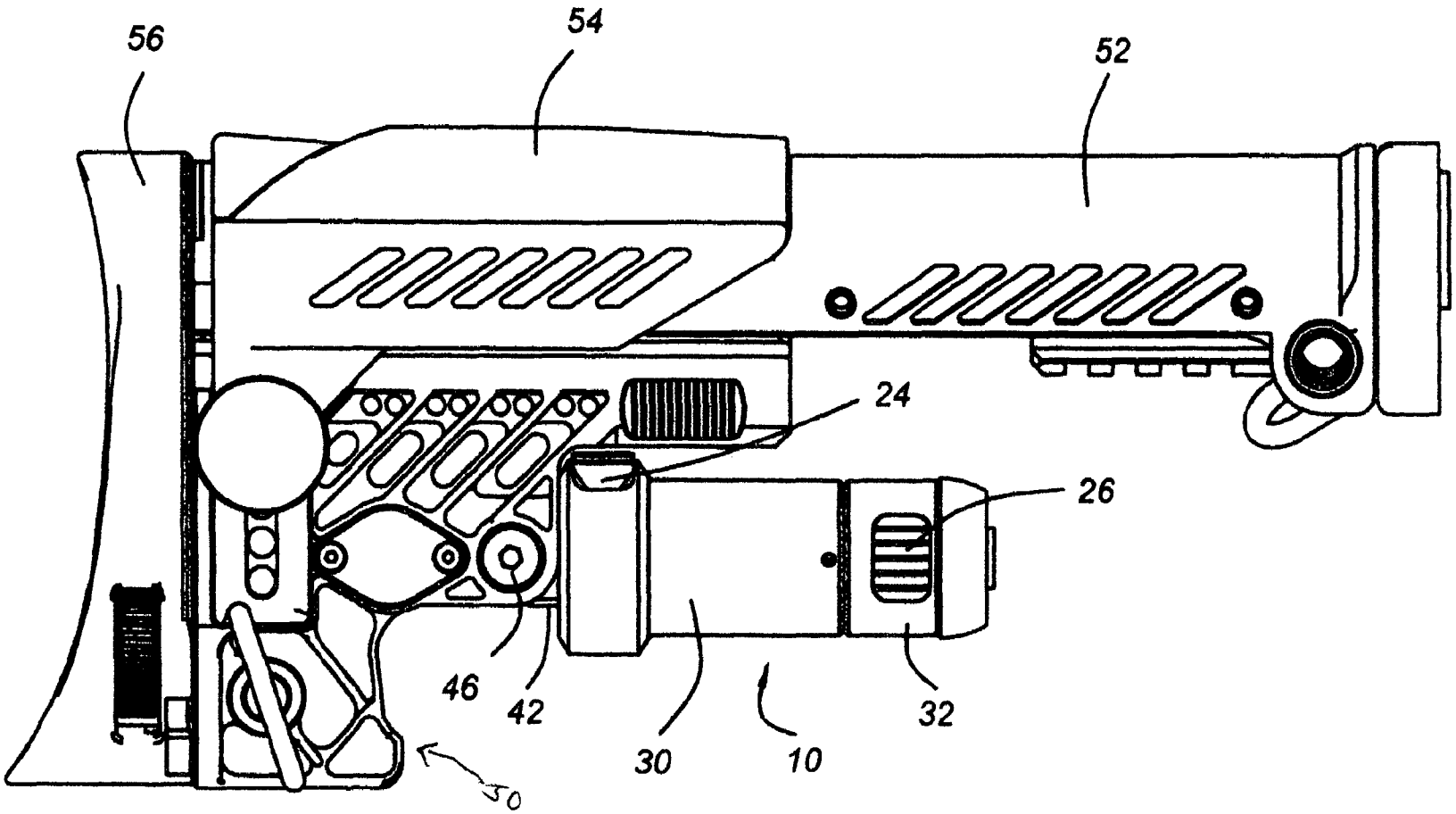
FIGS. 2*a* & 2*b* are schematic side and sectional illustrations of a stock for a firearm according to one embodiment of the present invention, with the telescoping leg according to FIG. 1 mounted thereon in a collapsed orientation.
Figure 2B:
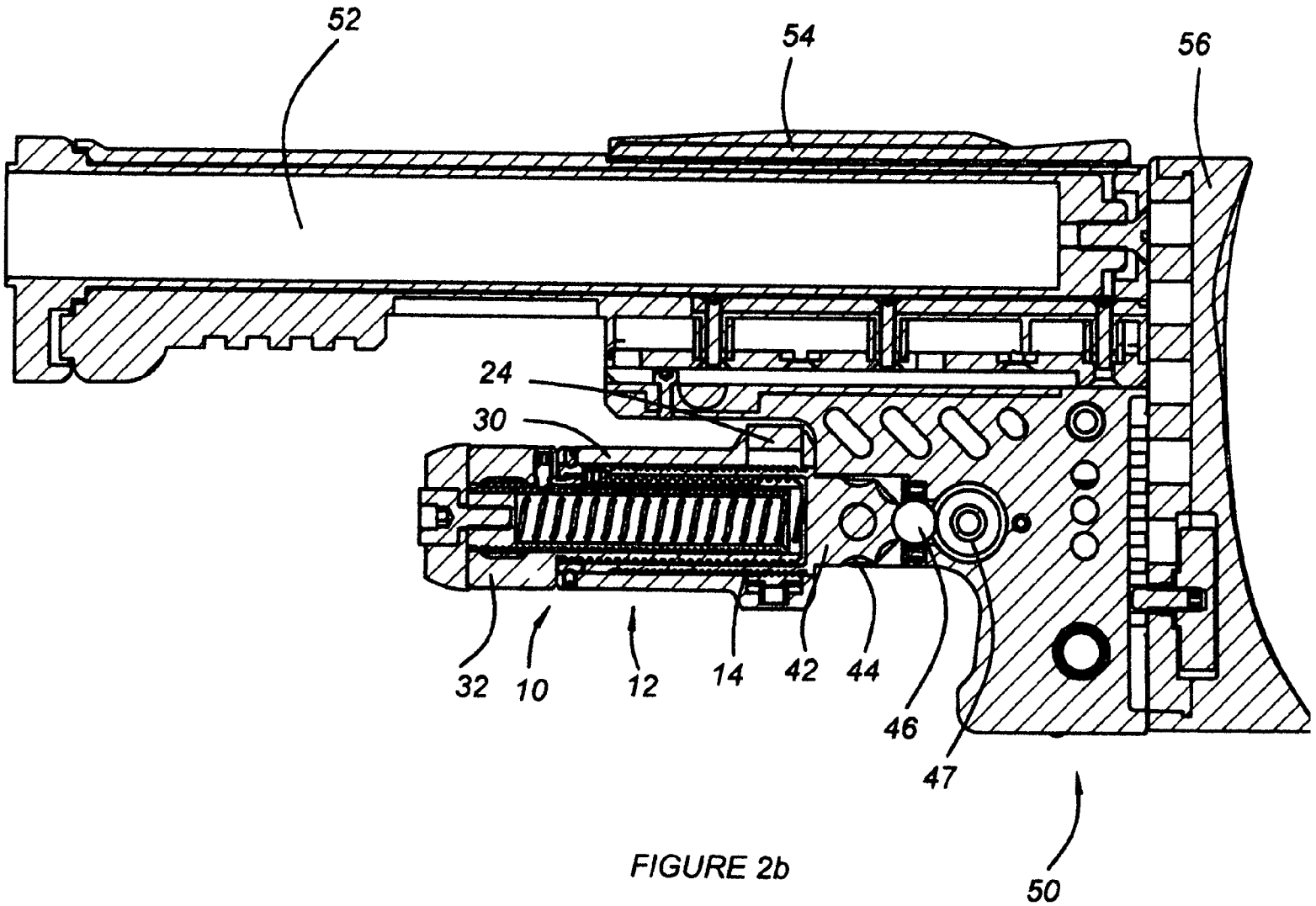

In the folded orientation of FIGS. 2*a* and 2*b*, the telescoping leg 10 is pivoted about pivot ball 46 and lies substantially parallel to buffer tube 52. As can be seen in FIG. 2*b*, first telescoping portion 14 is fully seated within housing 12 and second telescoping portion 20 is fully collapsed and seated within first telescoping portion 14.

Operation of the telescoping leg 10 is as follows. When the telescoping leg is collapsed, internal teeth on upper release button 24 engage screw threads 16, preventing relative movement between upper portion 14 and housing 12. Similarly, internal teeth on lower release button 26 engage screw threads 22, preventing relative movement between lower portion 20 and housing 12.

Inside leg 10 there is mounted first telescoping portion 14, for extending downwards to rest on a support surface. Inside of telescoping portion 14 there is mounted second telescoping portion 20 for lifting the stock to a desired height. According to a preferred embodiment of the invention, first telescoping portion 14 and second telescoping portion 20 are spring-biased for rapid extension.

Figure 3:
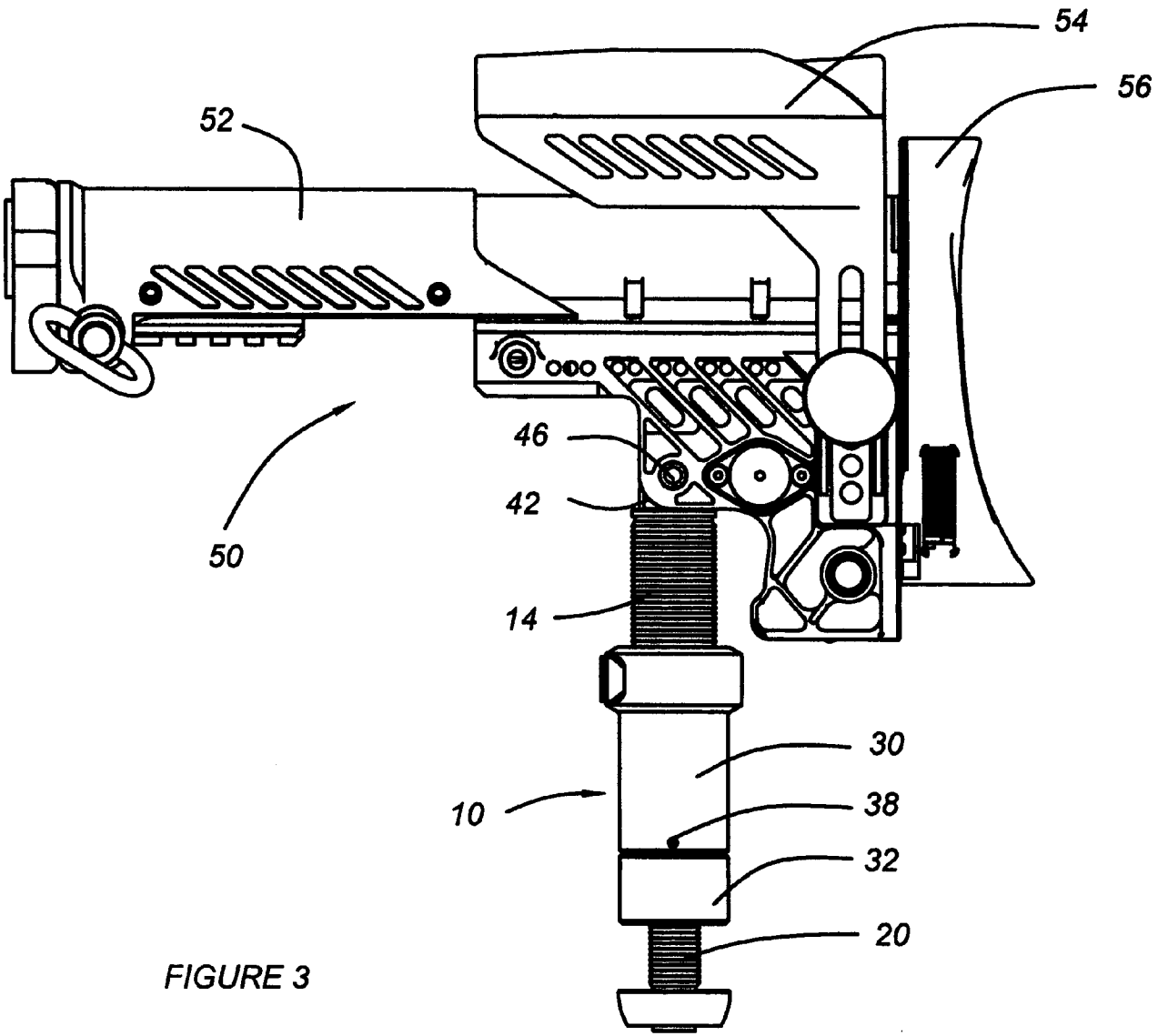
FIG. 3 is a side view of the stock of FIG. 2*a* in an open orientation.
Figure 4:
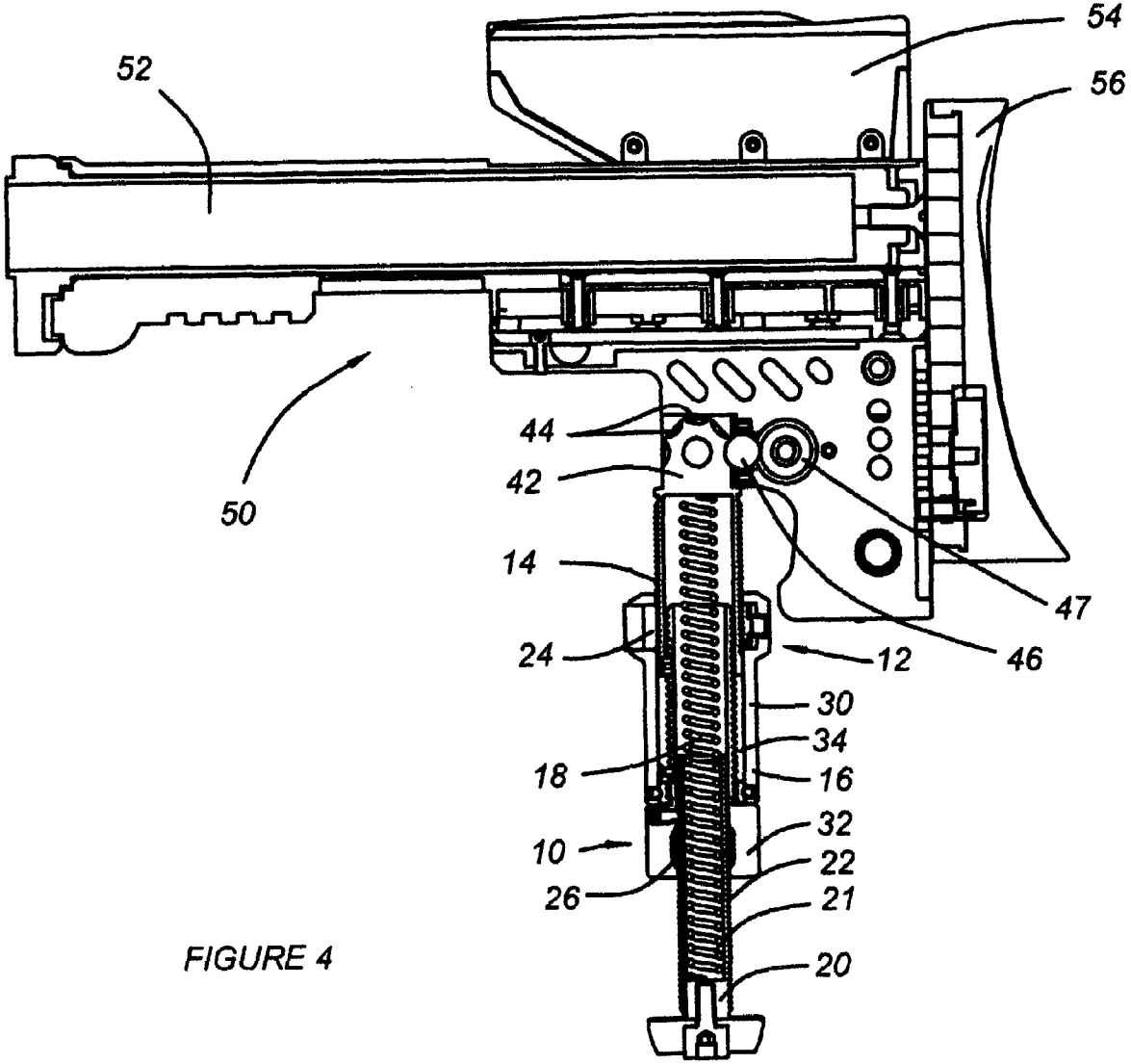
FIG. 4 is a schematic side sectional illustration of the stock of FIG. 2*a* in a fully open orientation.

On site, a shooter moves the firearm on which the stock is mounted in the direction of a target. When an approximate direction is reached, he can adjust the angle of the leg relative to the stock by pressing pivot release button 47 (seen in FIG. 2*b*) and pivoting the leg until ball 46 seats in a desired dimple 44. FIGS. 3 and 4 are respective side and sectional illustrations of stock 50 with telescoping leg 10 in a fully pivoted and extended orientation.

The shooter now presses lower release button 26, causing lower portion 20 to jump downwards under the urging of spring 18. The second portion 20 extends until the shooter releases lower release button 26, causing it to engage screw threads 22 again, or until the bottom of the leg contacts the ground or a wall or other support surface. The user may now press upper release button 24 causing first portion 14 to jump upwards, preferably under the urging of spring 18. This causes the entire firearm to rise relative to the support surface until the user releases upper release button 24, causing it to engage screw threads 16 again. Thus, telescoping portions 14 and 20 permit rapid gross adjustment of the length of the leg (height of the stock), both up and down, for locating a target.

In this way, it is easy to move the firearm and readjust the height and aim of the firearm as quickly and as often as necessary.

Fine adjustment of the length of the leg and the height of the stock is accomplished by rotating upper housing 30 relative to lower housing 32, or vice versa, about cylindrical portion 34. This permits precise adjustment of the desired height as the portions rotate about the screw threads.

Figure 5:
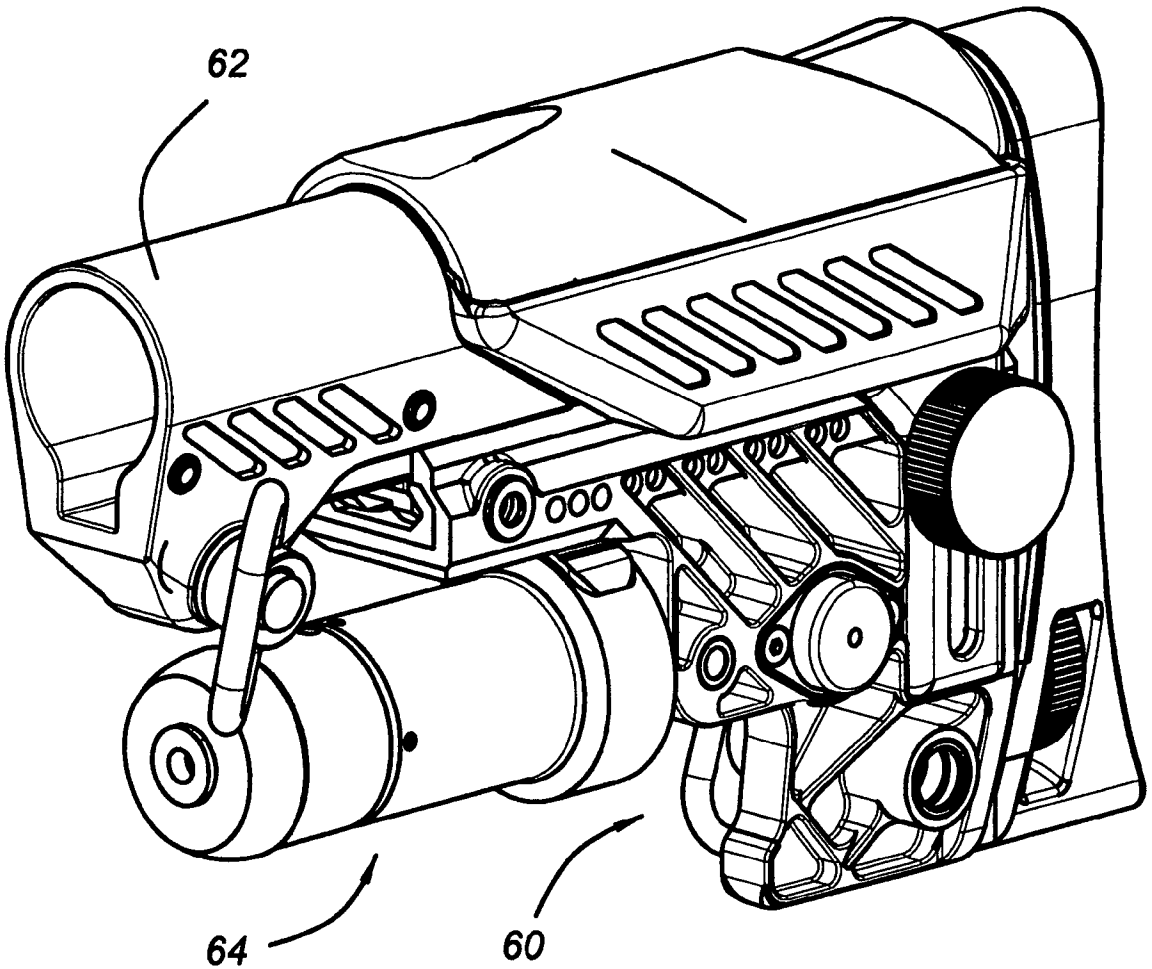
FIG. 5 is a schematic illustration of a stock for a firearm according to an alternative embodiment of the invention having a telescoping leg constructed and operative in accordance with the present invention in a folded orientation.

A stock 60 according to an alternative embodiment of the invention is shown in FIG. 5. As can be seen, stock 60 includes a buffer tube 62 designed to accept a short buffer, such as that in an M16 carbine or commando rifle., or any other rifle modified to accept this type of stock. Stock 60 also includes a pivotable, telescoping leg 64, substantially similar to that shown in FIG. 1. As can be seen, in this embodiment, telescoping leg 64 in its folded position is seated snugly against stock 60.

Figure 6B:
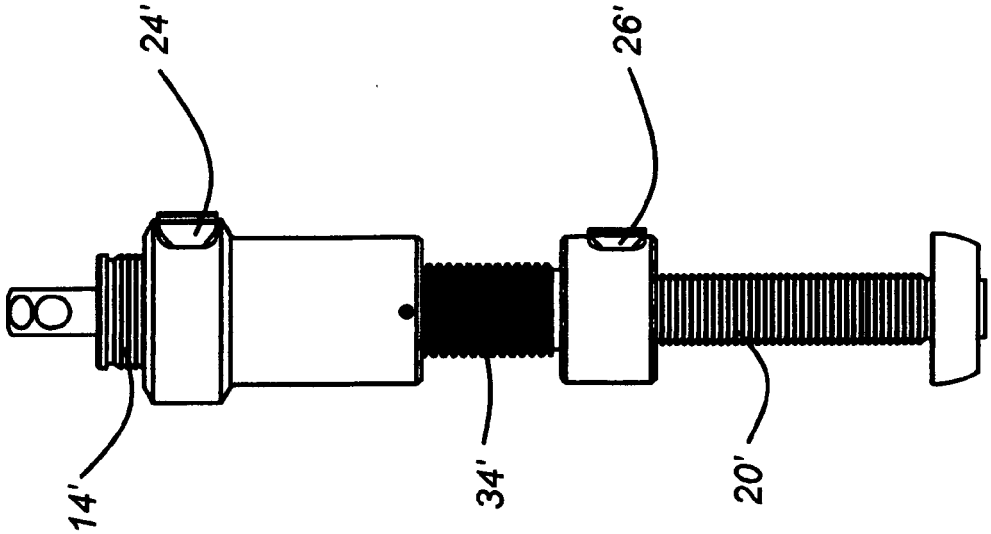
FIGS. 6*a* and 6*b* are respective sectional and plan illustrations of a telescoping leg according to another embodiment of the present invention.
Figure 6A:
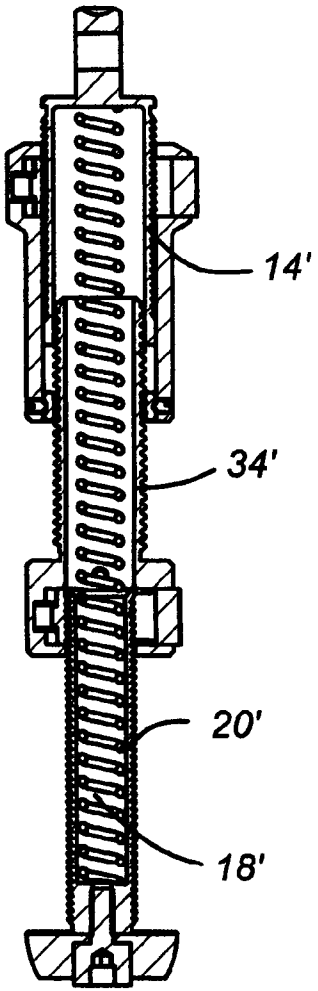

According to an alternative embodiment of the invention, the telescoping leg 10' may include only a single compression spring 18' which is mounted so as to extend either or both of the first telescoping portion 14' and the second telescoping portion 20', depending upon which release button is pressed, as shown in FIGS. 6*a* and 6*b*. 24' and 34' in FIGS. 6*a* and 6*b* have the same significances, respectively, as in FIG. 1.

It will be appreciated that the various elements of the telescoping leg 10 may be mounted on either side of the stock, for ease of use of a right handed or left handed shooter.

It is a particular feature of the present invention that the telescoping leg 10, when in its collapsed orientation, is only about one third its length when extended. It is a further particular feature that dividing the leg into two telescoping portions permits rapid and more accurate adjustment of the position of the stock for locating and focusing on a target.

While the invention has been described with respect to a limited number of embodiments, it will be appreciated that many variations, modifications and other applications of the invention may be made. It will further be appreciated that the invention is not limited to what has been described hereinabove merely by way of example. Rather, the invention is limited solely by the claims which follow.

The invention claimed is:

1. A telescoping leg for a firearm, the telescoping leg comprising:

a housing, a first telescoping portion mounted inside the housing, and a second telescoping portion mounted inside the first telescoping portion;

a first release button mounted in said housing for releasing said first telescoping portion;

a second release button mounted in said housing for releasing said second telescoping portion; and a screw thread portion for rotation of said housing about said second telescoping portion, for adjustment of the length of the leg while said second telescoping portion rests on a solid support.

2. The telescoping leg according to claim 1, wherein said first telescoping portion is spring loaded inside the housing, said first release button permitting said first telescoping portion to extend under urging of said spring.

3. The telescoping leg according to claim 2, wherein said second telescoping portion is spring loaded inside the first telescoping portion, said second release button permitting said second telescoping portion to extend under urging of said spring.

4. The telescoping leg according to claim 3, further comprising a pivot and locking mechanism permitting the leg to be pivoted and locked in each of several different positions, including a folded position adjacent a stock of the firearm, a fully open position substantially perpendicular to the folded position, and at least one stable intermediate shooting position between the folded position and the fully open position.

5. The telescoping leg according to claim 4, wherein said pivot and locking mechanism comprises:

a head portion having a plurality of dimples;

a complementary ball mounted in said stock;

whereby pivoting of the leg relative to said stock causes said ball to move between said dimples and to releasably lock in a selected dimple.

6. The stock according to claim 3, wherein said telescoping leg further comprises a pair of springs, one said spring biasing said first telescoping portion inside said housing; and said second spring biasing said second telescoping portion inside said first telescoping portion.

7. The stock according to claim 3, wherein said telescoping leg further comprises a spring biasing said first telescoping portion inside said housing; said spring also biasing said second telescoping portion inside said first telescoping portion.

8. The telescoping leg according to claim 1, further comprising a pivot and locking mechanism permitting the leg to be pivoted and locked in each of several different positions, including a folded position adjacent a stock of the firearm, a fully open position substantially perpendicular to the folded position, and at least one stable intermediate shooting position between the folded position and the fully open position.

9. The telescoping leg according to claim 8, wherein said pivot and locking mechanism comprises:

a head portion having a plurality of dimples;

a complementary ball mounted in said stock;

whereby pivoting of the leg relative to said stock causes said ball to move between said dimples and to releasably lock in a selected dimple.

10. A stock for a firearm, including a telescoping leg, said leg comprising:

a housing, a first telescoping portion mounted inside said housing;

means for extending said first telescoping portion;

a second telescoping portion mounted inside said first telescoping portion; and means for extending said second telescoping portion;

a first release button mounted in said housing for releasing said first telescoping portion;

a second release button mounted in said housing for releasing said second telescoping portion; and a screw thread portion for rotation of said housing about said second portion, for adjustment of the length of the leg while said second telescoping portion rests on a solid support.

11. The stock according to claim 10, wherein said telescoping leg further comprises a pair of springs, one said spring biasing said first telescoping portion inside said housing, said first release button permitting said first telescoping portion to extend under urging of said first spring; and said second spring biasing said second telescoping portion inside said first telescoping portion, said second release button permitting said second telescoping portion to extend under urging of said second spring.

12. The stock according to claim 10, wherein said telescoping leg further comprises a spring biasing said first telescoping portion inside said housing; said spring also biasing said second telescoping portion inside said first telescoping portion.

13. A method for forming a telescoping leg for a firearm, the method comprising:

mounting a first telescoping portion inside a housing;

providing means for extending said first telescoping portion;

mounting a second telescoping portion inside said first telescoping portion;

providing means for extending said second telescoping portion;

forming screw threads on said housing, said first telescoping portion and said second telescoping portion; and rotating said housing about said second telescoping portion for adjusting a length of the leg while said second telescoping portion rests on a solid support.

14. The method according to claim 13, wherein said step of mounting a first telescoping portion includes spring biasing said first telescoping portion inside said housing for release by said means for extending said first portion and said step of mounting a second telescoping portion includes spring biasing said second telescoping portion inside said first telescoping portion for release by said means for extending said second portion.

15. The method according to claim 14, wherein said step of mounting a first telescoping portion includes providing a first spring for biasing said first telescoping portion inside said housing; and said step of mounting a second telescoping portion includes providing a second spring for biasing said second telescoping portion inside said first telescoping portion.

16. The method according to claim 14, wherein steps of mounting a first telescoping portion and a second telescoping portion include providing a spring for biasing both said first telescoping portion inside said housing; and for biasing said second telescoping portion inside said first telescoping portion.

* * * * *